United States Patent [19]

Hirao et al.

[11] 4,377,424

[45] Mar. 22, 1983

[54] MOLD OF PRECIPITATION HARDENABLE COPPER ALLOY FOR CONTINUOUS CASTING MOLD

[75] Inventors: Yutaka Hirao, Toyama; Kunio Hata, Kurobe; Masao Hosoda; Ryoichi Ishigane, both of Toyama, all of Japan

[73] Assignee: Chuetsu Metal Works Co., Ltd., Tokyo, Japan

[21] Appl. No.: 265,390

[22] Filed: May 20, 1981

[51] Int. Cl.[3] ..... C22C 9/06

[52] U.S. Cl. ..... 148/414; 420/488

[58] Field of Search ..... 75/159, 153; 148/160, 148/32.5, 12.7 C; 164/443

[56] References Cited

U.S. PATENT DOCUMENTS

| | | | |
|---|---|---|---|
| 2,137,283 | 11/1938 | Hensel et al. | 75/159 |
| 2,289,593 | 7/1942 | Sawyer et al. | 75/159 |
| 3,170,204 | 2/1965 | Tarmann | 148/160 |
| 3,488,188 | 1/1970 | Paces et al. | 75/159 |
| 3,988,176 | 10/1976 | Watanabe et al. | 75/153 |
| 4,059,142 | 11/1977 | Alberny et al. | 164/443 |

FOREIGN PATENT DOCUMENTS

| | | | |
|---|---|---|---|
| 54-4232 | 1/1979 | Japan | 75/159 |
| 263885 | 2/1970 | U.S.S.R. | 75/159 |
| 406928 | 4/1974 | U.S.S.R. | 75/159 |

*Primary Examiner*—Peter K. Skiff

*Attorney, Agent, or Firm*—Andrew D. Maslow

[57] ABSTRACT

A precipitation hardenable alloy suitable for forming molds for continuous casting of steel and other metal containing, by weight, 0.2–2.0% nickel, 0.05–0.5% beryllium, 0.01–1.0% niobium and the balance essentially copper. The alloy is subjected to heat treatment including solution treatment and aging, so that it has improved strength, high thermal conductivity and high toughness at elevated temperatures. The alloy may contain 0.03–0.6 wt % zirconium, 0.03–0.6 wt % zirconium and 0.01–0.1 wt % magnesium, or 0.03–0.6 wt % zirconium and 0.01–0.2 wt % titanium in place of the 0.01–1.0 wt % niobium.

7 Claims, 13 Drawing Figures

1. ALLOY NO.3 OF THIS INVENTION
2. CORSON ALLOY
3. ALLOY NO.2 OF THIS INVENTION
4. ALLOY NO.1 OF THIS INVENTION
5. CHROMIUM COPPER
6. PHOSPHOROUS DEOXIDIZED COPPER

NUMERALS 1~6 REPRESENT THE SAME AS LEFT.

1. ALLOY NO.3 OF THIS INVENTION
2. CORSON ALLOY
3. ALLOY NO.2 OF THIS INVENTION
4. ALLOY NO.1 OF THIS INVENTION
5. CHROMIUM COPPER
6. PHOSPHOROUS DEOXIDIZED COPPER

NUMERALS 1~6 REPRESENT THE SAME AS LEFT.

MOLD OF PRECIPITATION HARDENABLE COPPER ALLOY FOR CONTINUOUS CASTING MOLD

BACKGROUND OF THE INVENTION

This invention relates to a novel copper base alloy provided with several excellent properties that render the alloy suitable for use in forming molds used for continuous casting of steel and other metals or alloys.

As is well known, molds formed of tough pitch copper, phosphorus deoxidized copper, or other pure copper base material have mainly been in use for carrying out continuous casting of steel and other metals or alloys, since the techniques of continuous casting have been developed. The principal reason why pure copper base material has been used for forming molds is that the material has excellent thermal conductivity which no other materials possess.

However, any material that is used for forming molds of this type is not considered perfect even if it has high thermal conductivity. Such material should additionally have strength that enables the material to exhibit an excellent anti-thermal deformation ability when liquid steel is poured into a mold and hardness which is high enough to increase the wear resistance of the mold.

When the material is low in thermal conductivity, the temperature difference between the surface of a mold and the water cooled surface thereof would be increased and the thermal stress of the material would increase, causing deformation and crack formation to occur in the mold. Tough pitch copper and phosphorus deoxidized copper that have hitherto been in use for forming molds have the tendency to undergo recrystallization and becoming softer at about 300° C. High hardness is a very important property for material used for forming continuous casting molds. The material is required to have a considerably high hardness to avoid deformation of the mold due to thermal stress of the material and to prevent wear and reduce scratches caused on the mold by the sliding movement of the solidified shell during a casting operation. A lack of hardness of the material would cause diffusion of wear powder into the steel to take place during the sliding movement of the solidified shell, thereby causing star cracks to be formed. When the scratches are large in size, breakout might be caused to occur.

Thus in addition to high thermal conductivity, material for continuous casting molds should be capable of avoiding the occurrence of wear and roughened skin on the inner wall surface of a mold and minimizing thermal strain and thermal deformation of the mold. As set forth hereinabove, tough pitch copper and phosphorus deoxidized copper have been in use over a prolonged period from the time the techniques of continuous casting were initially developed. However, these materials have in recent years raised the problems of deformation and crack formation occurring in molds when they are used in the field of high speed casting that has recently been making advances in which the molds are exposed to severe service conditions, since such materials have hitherto been used at the limit of their characteristics. Thus the present tendency in the metal casting industry is to call for material of high hardness at room and elevated temperatures even at the expense of the ability to transfer heat to a certain degree. This has introduced chromium copper known as precipitation hardenable type material and a C alloy known as a Corson alloy into the field of continuous casting as substitutes for tough pitch copper and phosphorus deoxidized copper of the prior art.

The reason why such materials have become popular is that precipitation hardenable type material has very high strength at elevated temperatures although its thermal conductivity is slightly lower than that of non-aging material, so that molds formed of this material very seldom develop deformation which is a determining factor concerned in the service life of the molds.

The chromium copper is capable of resisting deformation that would be caused by thermal stress produced during a continuous casting operation, but this material is also available only at the limit of its characteristics. The Corson alloy has the risk of developing cracks because it is low in strength at elevated temperatures in spite of being low in thermal conductivity and it is also low in elongation percentage. Thus these two materials lack properties that would make them satisfactorily meet the aforesaid conditions under which the continuous casting mold is forced to operate, and there is an increasingly large demand, among those who are engaged in this technical field, for material of high class for use in forming continuous casting molds.

Continuous casting of steel would tend in the future to be performed on a high speed operation basis so that unit production volume can be increased. In view of this tendency, the problem of deformation would arise with regard to chromium copper, and such material as has increased strength at elevated temperatures even if its thermal conductivity is somewhat low would be in demand.

A Be-Cu alloy in which beryllium is added to copper has been known as a precipitation hardenable type alloy that can be used as material of high strength at elevated temperatures. This material is available commercially as high strength, high heat conductive material. In the case of this alloy, an increase in the proportion of beryllium added to the copper markedly increases strength but reduces its heat conductivity. Conversely, a decrease in the proportion of beryllium, say to below 0.6%, prevents precipitation hardening from occurring. Thus in one type of this alloy, nickel is added to a composition including less than 0.5% of beryllium to lower the solubility of beryllium in copper, to cause precipitation hardening to occur even if the proportion of beryllium is less than 0.6%.

A Cu-Ni-Be alloy is high in strength and high in heat conductivity at room temperature and high in toughness at elevated temperatures, but shows a decrease in strength and elongation, particularly in elongation, when used under conditions in which the temperature rises to the range between 350°–400° C. as in continuous casting apparatus. This also applies to chrominum copper, and these materials always have the risk of being low in toughness when used under conditions of high temperature and high stress.

The Cu-Be-Ni alloy tends to show variations in property because a slight difference in heat treatment for effecting solutionizing and aging can cause a great change in its properties and coarsening of crystal grains. To avoid this disadvantage, proposals have been made to stabilize the alloy by adding cobalt. However, since cobalt adversely affects the heat conductivity of the alloy, the material added with cobalt is not suitable for use as material intended to have high heat conductivity.

SUMMARY OF THE INVENTION

This invention has been developed for the purpose of obviating the aforesaid disadvantages of the prior art. Accordingly, the invention has as its object the provision of a novel precipitation hardenable type alloy of high heat conductivity, high strength and high elongation at elevated temperature suitable for use as material for forming molds of continuous casting of steel.

The outstanding characteristic of the invention is that either niobium or zirconium is added to a Cu-Ni-Be alloy to provide a basic alloy which has increased strength and elongation at elevated temperatures while having the high heat conductivity of the Cu-Ni-Be alloy, and the basic alloy having zirconium added thereto is further added with either manganese or titanium in small amount, to produce an alloy suitable for use as material for forming continuous casting molds of improved high strength, high heat conductivity, high heat resistance and high toughness at elevated temperatures. The alloy according to the invention comprises first to fourth embodiments set forth hereinbelow, and each embodiment will now be described by referring to its example.

DESCRIPTION OF THE PREFERRED EMBODIMENTS

EMBODIMENT I

Figure 1:
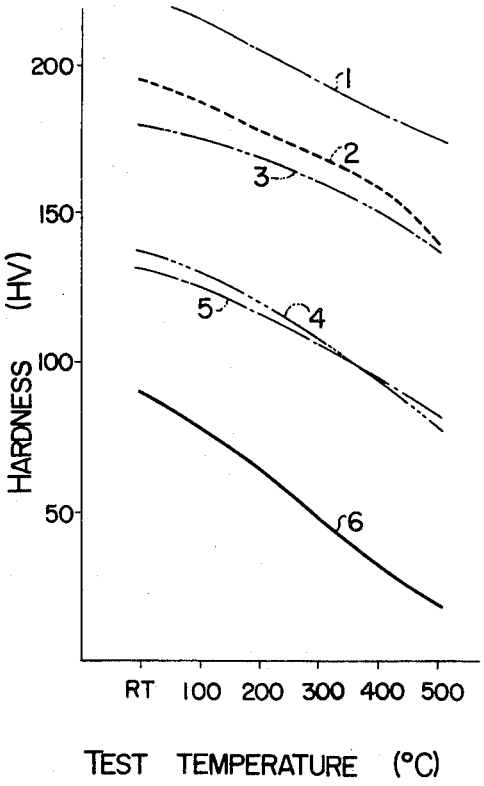
FIGS. 1–4 are diagrams showing the results of the comparison of the first embodiment of the alloy according to the invention with an alloy of the prior art with regard to hardness at elevated temperatures, tensile strength at elevated temperatures, 0.2% proof stress at elevated temperatures and annealing softening, respectively.
Figure 2:
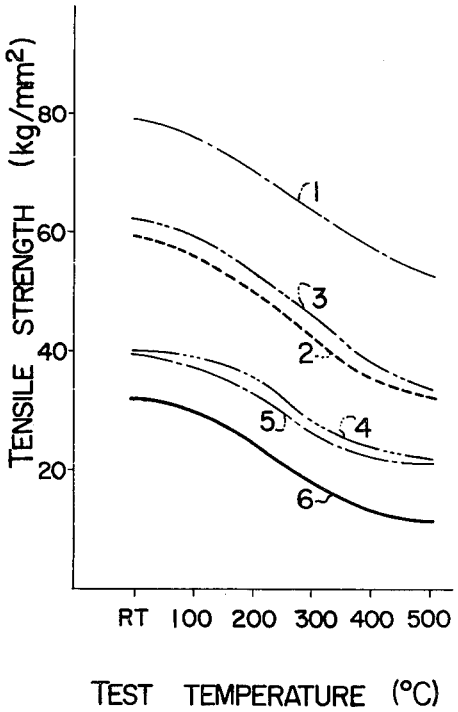
Figure 3:
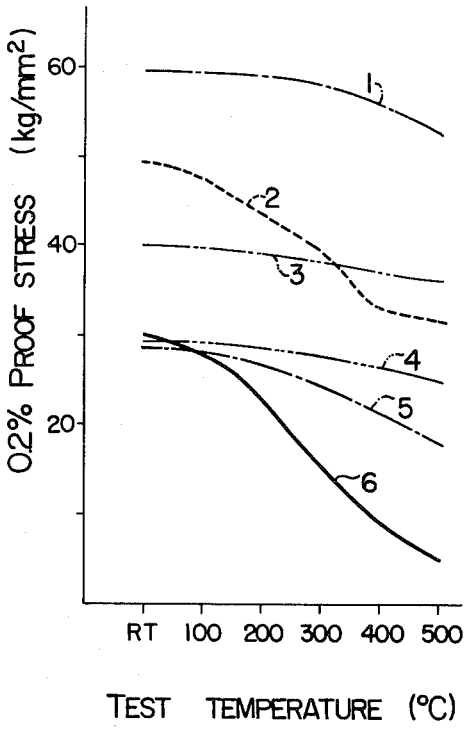
Figure 4:
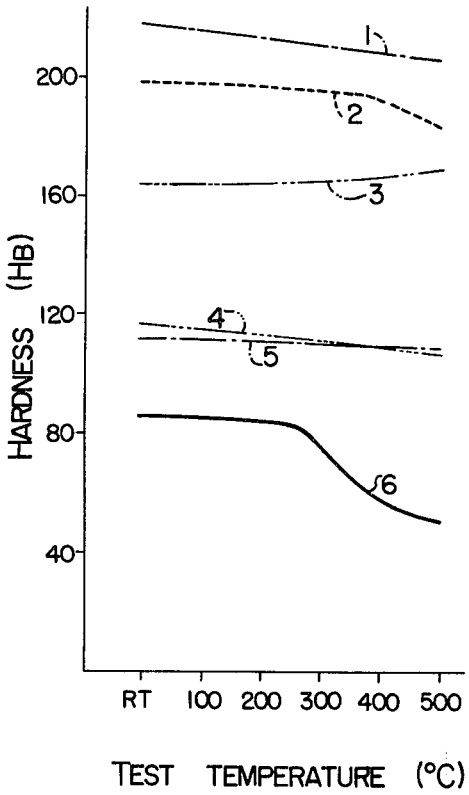

The mold material of this embodiment is an alloy of high strength, high heat conductivity and high heat resistance suitable for use as precipitation hardenable type material for forming molds of continuous casting of steel which consists by weight of 0.2–2.0% nickel, 0.05–0.5% beryllium, 0.01–1.0% niobium and the balance copper.

EXAMPLE

Tables 1 and 2 show the mechanical properties and electrical conductivity at room temperature and chemical compositions of the alloy according to the invention in comparison with those of tough pitch copper, phosphorus deoxidized copper, chromium copper and Corson alloy. FIGS. 1–4 are diagrammatic representations of the various properties of the alloy according to the invention in comparison with those of the aforesaid alloys of the prior art except for tough pitch copper, at elevated temperatures.

TABLE 1

| Mechanical Properties and Electric Conductivity at Room Temperature | | | | | | |
|---|---|---|---|---|---|---|
| | Tensile properties | | | | Electrical | |
| | Tensile strength (kgf/mm$^2$) | 0.2% Proof stress (kgf/mm$^2$) | Elongation (%) | Hardness $H_B$ (10/3000) | conductivity (IACS %) | Remarks |
| Tough pitch copper (H) | 29 | 27 | 16 | 85 | 100 | As forged. |
| Phosphorus deoxidized copper (H) | 32 | 30 | 23 | 89 | 95 | As forged. |
| Chromium copper | 38 | 28 | 29 | 110 | 88 | Forged and Heat treated.* |
| C Alloy | 59 | 49 | 18 | 185 | 40 | Forged and Heat treated.* |
| Alloy No. 1 of invention | 40 | 29 | 31 | 115 | 80 | Forged and Heat treated.* |
| Alloy No. 2 of invention | 63 | 40 | 23 | 165 | 65 | Forged and Heat treated.* |
| Alloy No. 3 of invention | 78 | 59 | 10 | 188 | 45 | Forged and Heat treated.* |

*solutionized and aged.

TABLE 2

| | Chemical Composition | | | | | | | |
|---|---|---|---|---|---|---|---|---|
| | Cu | Ni | Si | Cr | Nb | P | Mn | Be |
| Tough pitch copper | 99.95 | — | — | — | — | Tr. | — | — |
| Phosphorus deoxidized copper | 99.93 | — | — | — | — | 0.01 | — | — |
| Chromium copper | Bal. | — | — | 0.8 | — | — | — | — |
| C Alloy | Bal. | 2.3 | 0.46 | — | — | — | 0.12 | — |
| Alloy No. 1 | Bal. | 0.22 | — | — | 0.01 | — | — | 0.06 |

TABLE 2-continued

| | Chemical Composition | | | | | | | |
|---|---|---|---|---|---|---|---|---|
| | Cu | Ni | Si | Cr | Nb | P | Mn | Be |
| of invention | | | | | | | | |
| Alloy No. 2 of invention | Bal. | 1.03 | — | — | 0.12 | — | — | 0.19 |
| Alloy No. 3 of invention | Bal. | 1.98 | — | — | 0.94 | — | — | 0.48 |

These tables show clearly the properties of the alloys of the prior art described hereinabove. More specifically, it will be clearly seen in the tables that tough pitch copper and phosphorus deoxidized copper are markedly inferior to other alloys including the alloy according to the invention in mechanical properties, such as tensile strength and hardness, although they have a high heat transfer rate (electrical conductivity), so that they would encounter the problems of deformation or crack formation when used for forming molds for continuous casting of steel which nowadays is serviced at high speed under severe conditions. By the addition of chromium, nickel, silicon and manganese, chromium copper and C alloy have had their mechanical properties improved to a certain degree at the expense of their heat transfer rate. However, the aforesaid disadvantages are not completely obviated in these alloys which are still faced with the problems with regard to their durability that remain to be solved.

Table 3 shows the durability of the aforesaid various materials determined by calculating the thermal stresses produced in molds based on the heat transfer rate (electrical conductivity) of each material and comparing the results obtained with the strength of the mold materials determined while in service.

TABLE 3

| Mould material | Heat transfer rate (%) | Mould temp. during use (°C.) | Thermal stress of mould (kgf/mm²) | Tensile strength of mould material during use (kgf/mm²) | Proof stress of mould material during use (kgf/mm²) | Hardness of mould material during use (Hv) | Durability |
|---|---|---|---|---|---|---|---|
| Phosphorus deoxidized copper | 95 | 260 | 21 | 21 | 18 | 55 | Δ Elongation |
| Chromium copper | 85 | 280 | 22 | 28 | 25 | 110 | o Durable |
| C Alloy | 40 | 400 | 40 | 36 | 33 | 160 | x Crack formation |
| Alloy No. 1 of invention | 80 | 270 | 23 | 30 | 27 | 112 | o Durable |
| Alloy No. 2 of invention | 65 | 305 | 27 | 46 | 38 | 160 | o Durable |
| Alloy No. 3 of invention | 45 | 380 | 37 | 58 | 56 | 185 | o Durable |

In Table 3, it will be seen that phosphorus deoxidized copper (H) is unable to withstand thermal stresses during use and tends to be elongated at this temperature, so that this material undergoes deformation relatively readily and quickly due to elongation under stress. Chromium copper can withstand aimed use to some extent but it is at its limit with regard to thermal stresses, while C alloy lacks strength at elevated temperatures in spite of its heat transfer rate being rather low and its elongation is rather small, so that there is the risk of forming cracks. Meanwhile, it will be seen that the alloys No. 1, No. 2 and No. 3 of the invention have tensile strength, proof stress and hardness which are enough to render them suitable for forming molds that can withstand severe service conditions, as supported by the values shown in the table.

The copper-base alloy according to the invention suitable for use as material for forming molds for continuous casting of steel has been developed for the purpose of obtaining an alloy of high heat conductivity and high strength. Of the elements added to the base alloy for accomplishing the object, nickel is added to compensate for a reduction in precipitation hardening caused by a reduction in the amount of beryllium by reducing the solubility limit of beryllium. When the amount of the nickel added is less than 0.2%, no satisfactory result is obtained by its addition, and when the amount exceeds 2.0% the effects achieved are not so high in spite of the amount increased and the thermal conductivity is adversely affected by its addition. Beryllium is an important element for increasing the strength of the alloy by precipitation hardening, but its addition has no appreciable effect in increasing strength when the amount is less than 0.05% and its addition adversely affects thermal conductivity when the amount exceeds 0.5%. Addition of this element in amounts more than is necessary is uneconomical because this element is expensive. Niobium is added to achieve grain refinement purpose and increased strength at elevated temperatures. Addition of this element in suitable amounts enables a reduction in high temperature proof stress due to a rise in temperature to be minimized. However, when the amount is less than 0.01%, no appreciable results can be achieved, and when the amount is over 1.0% the effect achieved is not much and oxidation of molten steel is intensified, reducing the castability of the molten steel.

EMBODIMENT II

This embodiment of the alloy in conformity with the invention consists, by weight, of 0.2–2.0% nickel, 0.05–0.5% beryllium, 0.03–0.6% zirconium and the balance essentially copper. Ingots produced with this composition are processed through hot forging and rolling and then subjected to heat treatment, such as solutionizing and aging, to provide an alloy of high strength and high thermal conductivity and high toughness at elevated temperatures.

EXAMPLE

Figure 5:
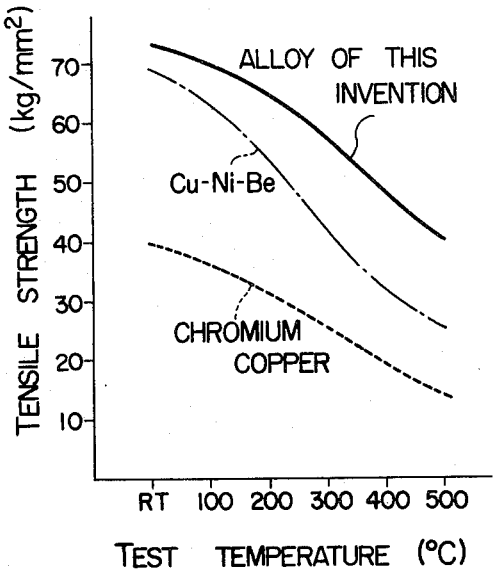
FIGS. 5–7 are diagrams showing the results of the comparison of the second embodiment of the alloy according to the invention with an alloy of the prior art with regard to high temperature properties such as tensile strength, proof stress and elongation at elevated temperatures, respectively.
Figure 6:
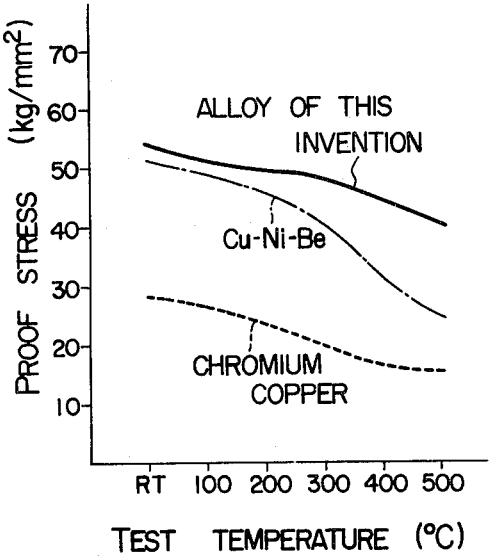
Figure 7:
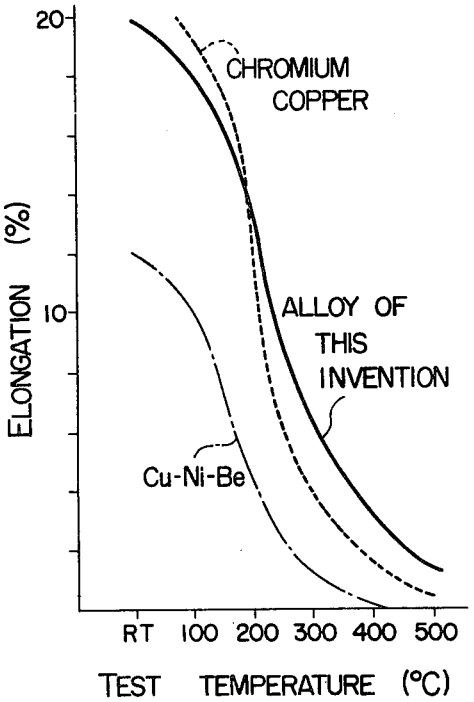

Table 4 shows the chemical composition and electrical conductivity of the alloy according to the invention in comparison with those of chromium copper and a Cu-Ni-Be alloy of the prior art. FIGS. 5–7 show the results of performance tests conducted on the alloys of the aforesaid compositions at elevated temperatures with regard to tensile strength, (FIG. 5), proof stress (FIG. 6) and elongation (FIG. 7) at elevated temperatures.

TABLE 4

| | Cu | Ni | Cr | Be | Zr | Electrical conductivity IACS (%) | Production method |
|---|---|---|---|---|---|---|---|
| Chromium Copper | Bal. | — | 0.82 | — | — | 85 | Forging and heat treatment |
| Cu-Ni-Be alloy | Bal. | 1.2 | — | 0.21 | — | 65 | Forging and heat treatment |
| Alloy of invention | Bal. | 1.1 | — | 0.19 | 0.20 | 66 | Forging and heat treatment |

In Table 4 as well as FIGS. 4–7, it will be clearly seen that the alloy according to the invention has higher strength and higher toughness with sufficient elongation at over 700° C. than chromium copper and Cu-Ni-Be alloy.

Of the ingredients of the alloy of this embodiment in conformity with the invention, nickel and beryllium have upper and lower limits which are the same as those described with reference to embodiment I, and the reasons for setting these ranges for the ingredients in embodiment II are the same as those described with reference to embodiment I.

Addition of zirconium has the effects of bringing about increased refinement of recrystalized grains and improved strength and elongation at elevated temperatures. When the amount of zirconium is less than 0.03%, it has little effects, and when its amount is over 0.6%, the effects achieved are little in spite of the large amount added and oxidization of molten steel increases, thereby rendering the alloy difficult to forge.

EMBODIMENT III

The alloy of this embodiment represents an improvement in the alloy of embodiment II, in which 0.01–0.1% magnesium is added to improve the characteristics of the alloy. This alloy consists, by weight, of 0.2–2.0% nickel, 0.05–0.5% beryllium, 0.03–0.6% zirconium, 0.01–0.1% magnesium and the balance essentially copper. The alloy of this composition is subjected to heat treatment including solutionizing and aging, to provide the alloy with the properties of high strength, high thermal conductivity, and high toughness at elevated temperatures. More specifically, nickel and beryllium are added to copper to produce a precipitation hardenable alloy that has high strength and high thermal conductivity at elevated temperatures. Further addition of zirconium and magnesium increases the strength of the alloy and improves its elongation at elevated temperatures.

EXAMPLE

Figure 8:
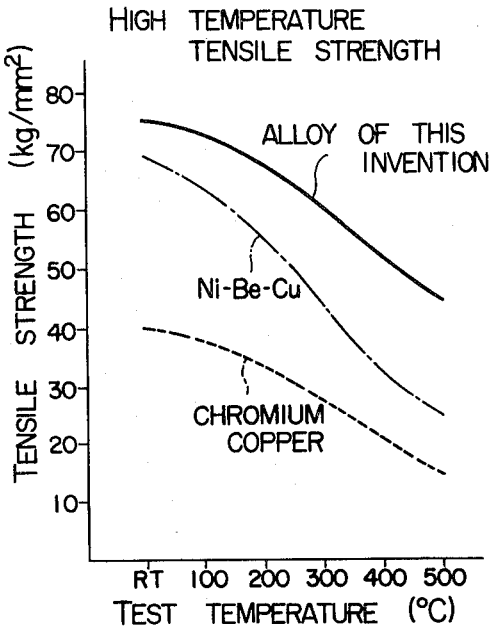
FIGS. 8–10 are diagrams showing the results of the comparison of the third embodiment of the alloy according to the invention with an alloy of the prior art with regard to such properties as tensile strength, proof stress and elongation at elevated temperatures, respectively.
Figure 9:
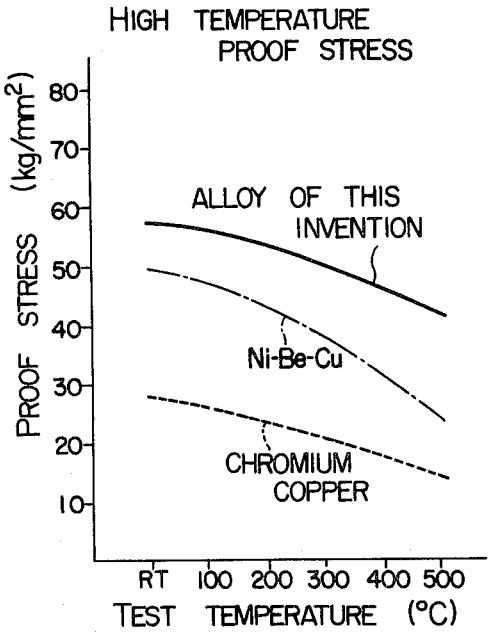
Figure 10:
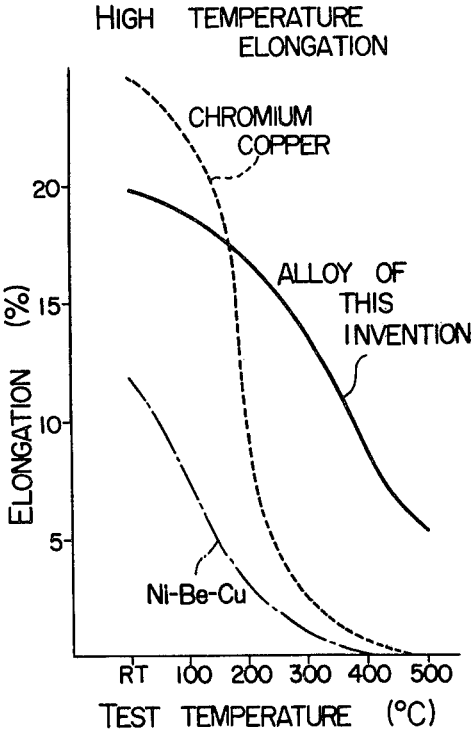

Table 5 shows the chemical composition and electrical conductivity of the alloy according to the invention in comparison with those of chromium copper and a Ni-Be alloy of the prior art. FIGS. 8–10 show the results of performance tests conducted on the alloys of the aforesaid compositions at elevated temperatures with regard to tensile strength (FIG. 8), proof stress (FIG. 9) and elongation (FIG. 10) at elevated temperature.

TABLE 5

| | Cu | Cr | Ni | Be | Zr | Mg | Electrical conductivity IACS (%) |
|---|---|---|---|---|---|---|---|
| Chromium copper | Bal. | 0.81 | — | — | — | — | 84 |
| Ni-Be copper | Bal. | — | 1.2 | 0.20 | — | — | 62 |
| Alloy of invention | Bal. | — | 1.0 | 0.19 | 0.20 | 0.03 | 66 |

Notes.
All the specimens were subjected to heat treatment including solutionizing and aging, following hot forging.

In Table 5, as well as FIGS. 8–10, it will clearly be seen that the alloy according to the invention has high strength and high toughness because it is higher in strength than chromium copper used nowadays for forming molds for continuous casting of steel and higher in toughness at 300°–350° C. at which the molds are put to service. It will also be clear that it is higher in strength and toughness than the Ni-Be copper which is an alloy of the same system.

As described hereinabove, the copper alloy according to the invention has been developed to produce a copper alloy of high thermal conductivity and high strength at elevated temperatures, and the alloy produced is provided with these properties. Of the ingredients of the alloy added to copper for achieving the desired results, nickel, beryllium and zirconium are added in the same amounts as those described with reference to embodiments I and II, and the reasons for setting the upper and lower limits for the ingredients in this embodiment are the same as those described with reference to embodiments I and II.

Magnesium is added to improve the elongation characteristic of the alloy at elevated temperatures. When its amount is less than 0.01%, the effect achieved is little, and when its amount is over 0.1%, the heat conductivity of the alloy is adversely affected, making the alloy unfit for forming molds.

EMBODIMENT IV

The alloy of this embodiment includes titanium added to the alloy of embodiment II in place of the magnesium added thereto in embodiment III, and consists, by weight, of 0.2–2.0% nickel, 0.05–0.5% beryllium, 0.03–0.6% zirconium, 0.01–0.2% titanium and the balance essentially copper. This alloy is subjected to heat treatment including solutionizing and aging to provide the alloy with the properties of high strength, high thermal conductivity and high toughness at elevated temperatures.

More specifically, nickel and beryllium are added to copper to produce a precipitation hardenable alloy that has high strength and high thermal conductivity at elevated temperatures. Further addition of zirconium and titanium improves its elongation at elevated temperatures without reducing its strength.

EXAMPLE

Figure 11:
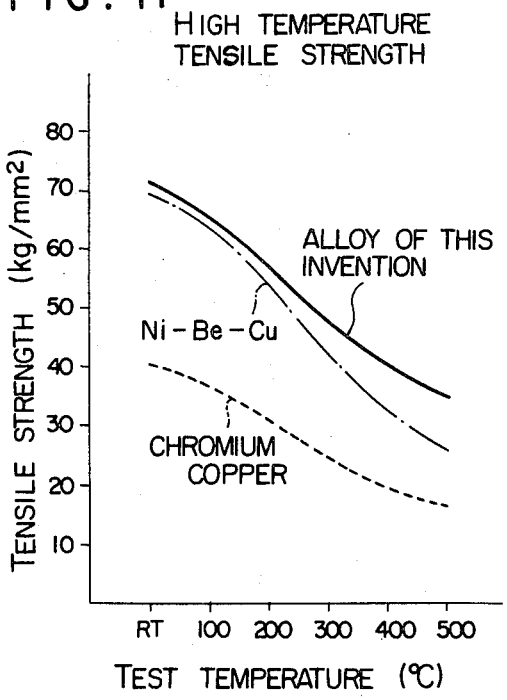
FIGS. 11–13 are diagrams showing the results of the comparison of the fourth embodiment of the alloy according to the invention with an alloy of the prior art with regard to such properties as tensile strength, proof stress and elongation at elevated temperatures, respectively.
Figure 12:
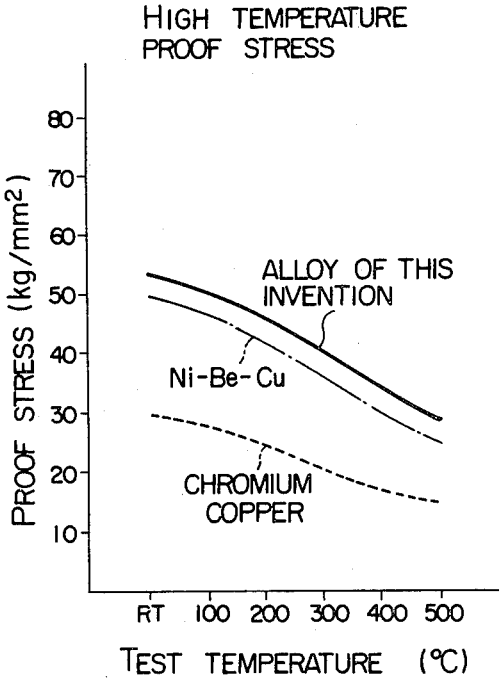
Figure 13:
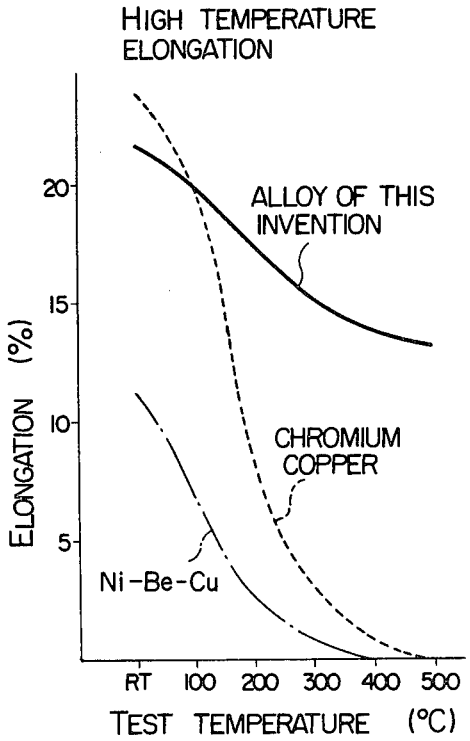

Table 6 shows the chemical composition and electrical conductivity of the alloy according to the invention in comparison with those of chromium copper and Ni-Be copper of the prior art. FIGS. 11–13 show the results of performance tests conducted on the alloys of the aforesaid compositions at elevated temperatures with regard to tensile strength (FIG. 11), proof stress (FIG. 12) and elongation (FIG. 13) at elevated temperatures.

TABLE 6

| | Cu | Cr | Ni | Be | Zr | Ti | Electrical conductivity IACS (%) |
|---|---|---|---|---|---|---|---|
| Chromium copper | Bal. | 0.81 | — | — | — | — | 84 |
| Ni-Be copper | Bal. | — | 1.2 | 0.20 | — | — | 62 |
| Alloy of invention | Bal. | — | 1.0 | 0.20 | 0.20 | 0.05 | 60 |

Notes:
All the specimens were subjected to heat treatment including solutionizing and aging, following hot forging.

In Table 6 as well as FIGS. 11–13, it will be clearly seen that the alloy according to the invention has high strength and high toughness because it has higher strength than chromium copper used nowadays for forming molds for continuous casting of steel and higher toughness at 300°–350° C. at which the molds are put to service. It will also be clear that it is higher in strength and toughness than the Ni-Be copper which is an alloy of the same system.

As described hereinabove, the copper alloy according to the invention has been developed to obtain a copper alloy of high thermal conductivity and high strength and high toughness at elevated temperatures, and the alloy produced is provided with these properties. Of the ingredients of the alloy added to copper for achieving the desired results, the upper and lower limits of nickel, zirconium and beryllium are the same as those described with reference to embodiments II and III and the reasons for setting these ranges for the ingredients in this embodiment are the same as those described with reference to embodiments II and III.

Titanium is added to improve elongation at elevated temperatures. When its amount is less than 0.01%, it has little effect, and when its amount is over 0.2%, its addition markedly reduces the thermal conductivity of the alloy, making it unfit for forming molds.

From the foregoing description, it will be appreciated that each of the embodiments I–IV of the alloy in conformity with the invention has the properties of its strength and toughness at elevated temperatures not reduced even if it is put to prolonged service at about 350° C. and its thermal conductivity improved as a result of the reduction in the amount of beryllium, because the alloy is subjected to solution treatment and subsequent precipitation hardening treatment. Thus the alloy according to the invention is higher in strength, thermal conductivity and toughness at elevated temperatures than chromium copper and a Cu-Ni-Be alloy which are precipitation hardenable type alloys, to say nothing of tough pitch copper, phosphorus deoxidized copper and phosphorus deoxidized copper added with silver which are not precipitation hardenable type alloys. The alloy according to the invention has particular utility as material for forming molds for continuous casting of steel and other metal.

What is claimed is:

1. A mold for continuous casting of metals having high strength, high thermal conductivity and high heat resistance consisting of a precipitation hardenable alloy consisting essentially, by weight, of 0.2–2.0% nickel, 0.05–0.5% beryllium, 0.01–1.0% niobium and the balance essentially copper, wherein the mold has an electric conductivity of at least 65% IACS.

2. A mold for continuous casting of metals consisting of a precipitation hardenable alloy consisting essentially, by weight, of 0.2–2.0% nickel, 0.05–0.5% beryllium, 0.03–0.6% zirconium and the balance being copper, wherein the mold is provided with the properties of high strength, high electrical conductivity and high toughness at elevated temperatures due to heat treatment including solution treatment and aging to which the mold is subjected.

3. A mold for continuous casting of metals consisting of a precipitation hardenable alloy consisting, essentially by weight, of 0.2–2.0% nickel, 0.05–0.5% beryllium, 0.03–0.6% zirconium, 0.01–0.1% magnesium and the balance being copper, wherein the mold is provided with the properties of high strength, high electrical conductivity and high toughness at elevated temperatures due to heat treatment including solution treatment and aging to which the mold is subjected.

4. A mold for continuous casting of metals consisting of a precipitation hardenable alloy consisting essentially, by weight, of 0.2–2.0% nickel, 0.05–0.5% beryllium, 0.03–0.6% zirconium, 0.01–0.2% titanium and the balance being copper, wherein the mold is provided with the properties of high strength, high electrical conductivity and high toughness at elevated temperatures due to heat treatment including solution treatment and aging to which the mold is subjected.

5. A mold as claimed in any one of claims 2–4 or 1 wherein the amount of nickel is from 0.2 to less than 1.0 by weight percent.

6. A mold as claimed in any one of claims 2–4, wherein the amount of zirconium is from 0.03 to less than 0.5 by weight percent.

7. A mold as claimed in any one of claims 2–4, wherein the amount of nickel is from 0.2 to less than 1.0 by weight percent and the amount of zirconium is from 0.03 to less than 0.5 by weight percent.

* * * * *

UNITED STATES PATENT AND TRADEMARK OFFICE

CERTIFICATE OF CORRECTION

PATENT NO. : 4,377,424

DATED : March 22, 1983

INVENTOR(S) : Yutaka Hirao et al

It is certified that error appears in the above-identified patent and that said Letters Patent is hereby corrected as shown below:

On the title page Insert:

-- (30) Foreign Application Priority Data

| | | |
|---|---|---|
| May 26, 1980 | Japan | 55-70543 |
| Aug. 11, 1980 | Japan | 55-110131 |
| Sept. 3, 1980 | Japan | 55-122050 |
| Oct. 13, 1980 | Japan | 55-142740 -- |

Signed and Sealed this

*Twenty-first* Day of *June 1983*

[SEAL]

*Attest:*

DONALD J. QUIGG

*Attesting Officer*

*Acting Commissioner of Patents and Trademarks*